US010646054B2

(12) United States Patent
Watanabe

(10) Patent No.: US 10,646,054 B2
(45) Date of Patent: May 12, 2020

(54) SHOWCASE AND OPERATION METHOD THEREOF

(71) Applicant: Panasonic Intellectual Property Management Co., Ltd., Osaka (JP)

(72) Inventor: Keiko Watanabe, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 126 days.

(21) Appl. No.: 15/442,118

(22) Filed: Feb. 24, 2017

(65) Prior Publication Data

US 2017/0280896 A1 Oct. 5, 2017

(30) Foreign Application Priority Data

Mar. 31, 2016 (JP) ..... 2016-073402

(51) Int. Cl.
*A47F 3/04* (2006.01)

(52) U.S. Cl.
CPC ..... *A47F 3/0447* (2013.01); *A47F 3/0478* (2013.01); *A47F 3/0482* (2013.01)

(58) Field of Classification Search
CPC .... A47F 3/0447; A47F 3/0439; A47F 3/0482; A47F 3/0478; F24F 9/00
USPC ..... 454/190
See application file for complete search history.

(56) References Cited

U.S. PATENT DOCUMENTS 3,018,712 A * 1/1962 Wacker ..... F24F 9/00 454/192
3,233,423 A * 2/1966 Beckwith ..... A47F 3/0447 454/193
3,256,799 A * 6/1966 Beckwith ..... A47F 3/0447 454/190
3,291,027 A * 12/1966 Beckwith ..... A47F 3/0447 454/190
3,397,631 A * 8/1968 Simons ..... F24F 9/00 432/64
4,302,946 A * 12/1981 Ibrahim ..... A47F 3/0447 62/234
4,341,081 A * 7/1982 Ibrahim ..... A47F 3/0447 62/151
4,648,247 A * 3/1987 Takizawa ..... A47F 3/0447 62/256
4,993,233 A * 2/1991 Borton ..... A47F 3/0447 62/155

(Continued)

FOREIGN PATENT DOCUMENTS

JP 2010-203740 9/2010

*Primary Examiner* — Steven B McAllister
*Assistant Examiner* — Allen R Schult
(74) *Attorney, Agent, or Firm* — McDermott Will & Emery LLP

(57) ABSTRACT

A showcase includes: a casing having a front opening through which a product is picked up; a product storage located in the casing and including a shelf on which the product is displayed; a first airflow generator that sends air for a first air curtain to flow outside along the product storage; a second airflow generator that sends air for a second air curtain to flow outside along the first air curtain; and a controller that causes the first airflow generator to operate and causes the second airflow generator to reduce an output of the second airflow generator from an output at a first timing, upon arrival of a second timing when a break of the second air curtain due to disturbance is greater than a break of the second air curtain at the first timing.

9 Claims, 6 Drawing Sheets

(56) References Cited

U.S. PATENT DOCUMENTS 5,048,303 A * 9/1991 Campbell ..... A47F 3/0447 62/256
5,138,843 A * 8/1992 Tamayama ..... A47F 3/0447 62/256
5,317,881 A * 6/1994 Colvin ..... A47F 3/0443 62/209
5,761,922 A * 6/1998 Tamai ..... A47F 3/0447 62/256
6,619,052 B1 * 9/2003 Nash, Jr. ..... A47F 3/0443 62/186
6,722,149 B1 * 4/2004 Saroka ..... A47F 3/0447 454/193
6,742,344 B2 * 6/2004 Vormedal ..... A47F 3/0447 454/193
6,775,994 B1 * 8/2004 Math ..... A47F 3/0447 62/186
7,158,863 B1 * 1/2007 Johnson ..... A47F 3/0447 62/256
7,681,409 B2 * 3/2010 Alahyari ..... A47F 3/0447 62/255
2003/0172670 A1 * 9/2003 Vormedal ..... A47F 3/0447 62/407
2005/0138943 A1 * 6/2005 Alahyari ..... A47F 3/0447 62/256
2006/0042288 A1 * 3/2006 Downs ..... A47F 3/0447 62/256
2007/0012059 A1 * 1/2007 Roche ..... A47F 3/0447 62/256
2009/0205351 A1 * 8/2009 Fung ..... A47F 3/0447 62/256
2009/0215381 A1 * 8/2009 Swofford ..... A47F 3/0447 454/193
2011/0259031 A1 * 10/2011 Anderson ..... A47F 3/0447 62/251
2016/0058207 A1 * 3/2016 Choueifati ..... A47F 3/0447 62/256
2017/0231403 A1 * 8/2017 Eget ..... A47F 3/001 454/192

* cited by examiner

SHOWCASE AND OPERATION METHOD THEREOF

BACKGROUND

1. Technical Field

The present disclosure relates to a showcase and the like using an air curtain.

2. Description of the Related Art

Techniques related to a showcase and the like using an air curtain have been proposed heretofore. For example, an energy-saving operation for an open showcase that has a cooling structure using a double-layer air curtain system has been proposed in Japanese Unexamined Patent Application Publication No. 2010-203740.

SUMMARY

However, an air curtain may be broken by disturbance, and such a break of the air curtain may increase the cooling load of the showcase.

One non-limiting and exemplary embodiment provides a showcase and the like, which can reduce the increase of the cooling load due to disturbance.

In one general aspect, the techniques disclosed here feature a showcase that includes: a casing having an opening at a front face from which to take out a product; a product storage that is provided in the casing and includes a shelf on which to display the product; a first airflow generator that sends air for a first air curtain to flow outside the product storage; a second airflow generator that sends air for a second air curtain to flow outside the first air curtain; and a controller that causes the first airflow generator to operate and causes the second airflow generator to reduce an output of the second airflow generator from the output at a first timing, upon arrival of a second timing when a break of the second air curtain due to disturbance is greater than the break at the first timing.

The showcase and the like according to the above aspect of the present disclosure reduce an increase of a cooling load due to disturbance of the air curtain.

It should be noted that comprehensive or specific aspects may be implemented as a system, a device, a method, an integrated circuit, a computer program, a non-transitory computer-readable record medium such as a CD-ROM, or any combination thereof.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION (Underlying Knowledge Forming Basis of the Present Disclosure)

The inventor found a problem in regard to a showcase and the like using an air curtain. Detailed description of the problem is given below.

Figure 1:
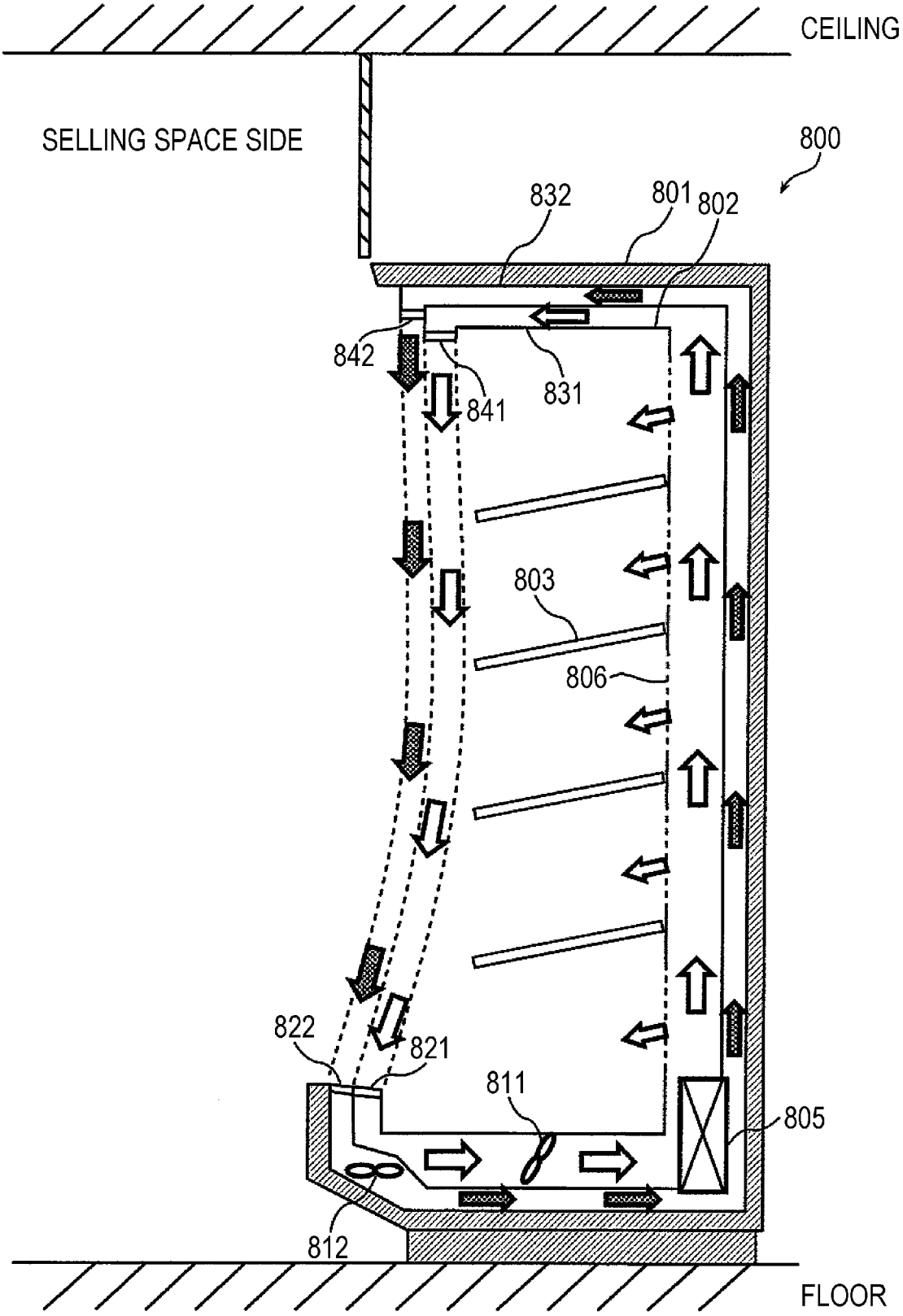
FIG. 1 is a configuration diagram that illustrates a showcase using a dual air curtain system in a reference example.

FIG. 1 is a configuration diagram that illustrates a showcase using a dual air curtain system in a reference example. A showcase 800 illustrated in FIG. 1 is an open showcase which is installed in a store or the like, and uses a dual air curtain.

The showcase 800 includes elements such as a casing 801, a product storage 802, shelves 803, a cooler 805, slits 806, an inner-layer circulation fan 811, an outer-layer circulation fan 812, an inner-layer air curtain intake 821, an outer-layer air curtain intake 822, an inner-layer circulation duct 831, an outer-layer circulation duct 832, an inner-layer air curtain outlet 841, and an outer-layer air curtain outlet 842.

The casing 801 has an opening face. The air for the inner-layer air curtain and the air for the outer-layer air curtain flow along the opening face of the casing 801. With this, the dual air curtain is formed along the opening face of the casing 801. The air for the inner-layer air curtain is sucked into the inner-layer air curtain intake 821, and the air for the outer-layer air curtain is sucked into the outer-layer air curtain intake 822.

Then, the air for the inner-layer air curtain and the air for the outer-layer air curtain are cooled by the cooler 805. For an ordinary dual air curtain other than a later-described simple dual air curtain, both the air for the inner-layer air curtain and the air for the outer-layer air curtain are cooled. Thereafter, again, the air for the inner-layer air curtain flows from the inner-layer air curtain outlet 841, and the air for the outer-layer air curtain flows from the outer-layer air curtain outlet 842.

The slits 806 are provided on a back panel of the product storage 802. The cooled air is sent from the inner-layer circulation duct 831 through the slits 806 to the inside of the product storage 802. With this, the inside of the product storage 802 is cooled.

However, due to disturbance of the dual air curtain, the air outside the dual air curtain may be mixed with the air of the dual air curtain, and be sucked into the inner-layer air curtain intake 821 or the outer-layer air curtain intake 822. Accordingly, the cooling load of the showcase 800 may be increased.

Figure 2:
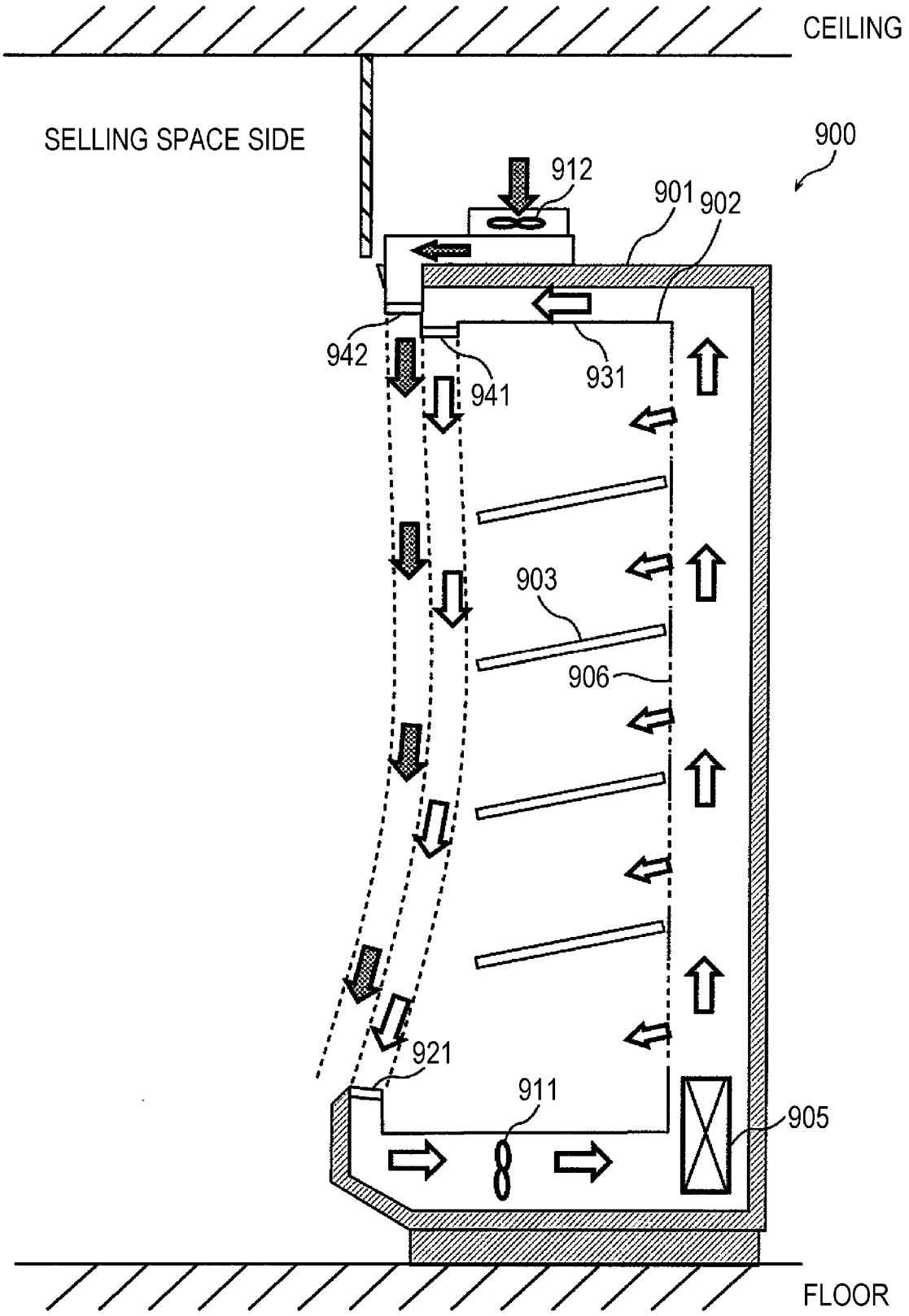
FIG. 2 is a configuration diagram that illustrates a showcase using a simple dual air curtain system in a reference example.

FIG. 2 is a configuration diagram that illustrates a showcase using a simple dual air curtain system in a reference example. A showcase 900 illustrated in FIG. 2 is an open showcase installed in a store and the like, which uses a simple dual air curtain.

The showcase 900 includes elements such as a casing 901, a product storage 902, shelves 903, a cooler 905, slits 906, a cold air circulation fan 911, a non-cold air circulation fan 912, an inner-layer air curtain intake 921, a cold air circulation duct 931, an inner-layer air curtain outlet 941, and an outer-layer air curtain outlet 942.

The casing 901 has an opening face. The air for the inner-layer air curtain and the air for the outer-layer air curtain flow along the opening face of the casing 901. With this, the dual air curtain is formed along the opening face of the casing 901. The air for the inner-layer air curtain is sucked into the inner-layer air curtain intake 921. Then, the air for the inner-layer curtain is cooled by the cooler 905. Thereafter, the air for the inner-layer curtain again flows from the inner-layer air curtain outlet 941.

The slits 906 are provided on a back panel of the product storage 902. The cooled air is sent from the cold air circulation duct 931 through the slits 906 to the inside of the product storage 902. With this, the inside of the product storage 902 is cooled.

Meanwhile, the air for the outer-layer air curtain is sucked from around a top panel of the casing 901 through the non-cold air circulation fan 912 disposed on the top panel, and the sucked air flows from the outer-layer air curtain outlet 942.

The showcase 800 using the ordinary dual air curtain includes the inner-layer circulation duct 831 and the outer-layer circulation duct 832. On the other hand, the showcase 900 using the simple dual air curtain includes the cold air circulation duct 931 corresponding to the inner-layer circulation duct 831, but no duct corresponding to the outer-layer circulation duct 832 because the showcase 900 sucks the air from around the top panel. This reduces the cost for the showcase 900.

However, due to disturbance of the dual air curtain, the air outside the dual air curtain may be mixed with the air of the dual air curtain, and be sucked into the inner-layer air curtain intake 921. Accordingly, the cooling load of the showcase 900 may be increased.

In addition, the showcase 900 using the simple dual air curtain does not cool the air for the outer-layer air curtain. Thus, a temperature of the air for the outer-layer air curtain in the showcase 900 using the simple dual air curtain may be higher than that of the outer-layer air curtain in the showcase 800 using the ordinary dual air curtain. In a season when the temperature of external air is high, such as summer, such hot air around the top panel may be sucked into the non-cold air circulation fan 912 for the outer-layer air curtain, and accordingly the temperature of the air for the outer-layer air curtain may be higher than the temperature of the air in a selling space (the air outside the dual air curtain).

Disturbance of the dual air curtain may allow the hot air for the outer-layer air curtain to flow into the product storage 902. To be more specific, the hot air for the outer-layer air curtain may be mixed with the air for the inner-layer air curtain, and be sucked into the inner-layer air curtain intake 921. This may increase the cooling load of the showcase 900.

Figure 3:
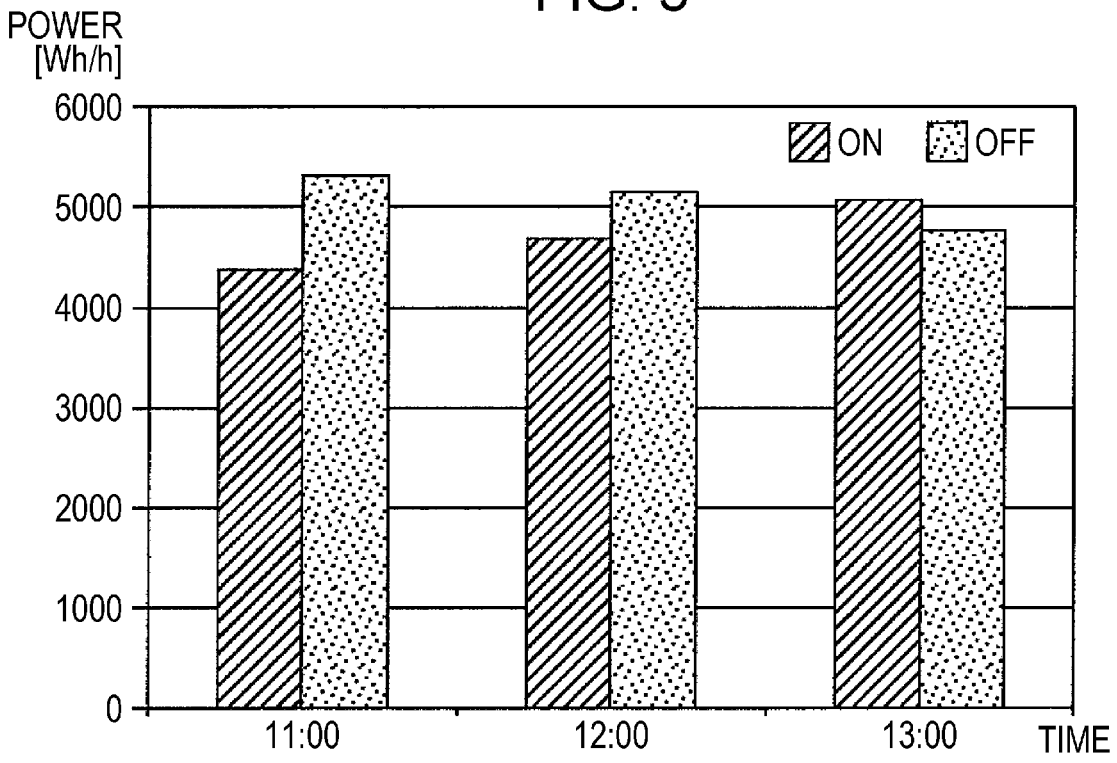
FIG. 3 is a graph that illustrates power consumption of the showcase in the reference example.

FIG. 3 is a graph that illustrates power consumption of the showcase 900 illustrated in FIG. 2. Specifically, the graph presents measurement results per hour of the power consumption of the showcase 900 where the outer-layer air curtain is ON and the power consumption of the showcase 900 where the outer-layer air curtain is OFF.

The outer-layer air curtain reduces the amount of the air outside the outer-layer air curtain flowing into the product storage 902. Accordingly, it is natural to consider that the power consumption of the showcase 900 is smaller when the outer-layer air curtain is ON (in the ON state) than when the outer-layer air curtain is OFF (in the OFF state). This is because, when the outer-layer air curtain is OFF, the cooling load of the showcase 900 may increase by an amount exceeding an amount by which the power consumption of the non-cold air circulation fan 912 decreases. Nevertheless, at 1:00 PM in the graph in FIG. 3, the power consumption in the ON state is greater than that in the OFF state.

One presumable reason of this phenomenon is as follows. When the number of customers in the store is increased, an increased number of customers take out products from the showcase, and disturb the dual air curtain in the ON state so much that the air for the outer-layer air curtain, the air from the selling space, and the like are sucked into the inner-layer air curtain intake 921, which greatly increases the cooling load of the showcase 900. On the other hand, in the OFF state, the cooling load of the showcase 900 may be kept low; because the amount of such hot air sucked into the inner-layer air curtain intake 921 is smaller than that in the ON state, and this allows the air for the inner-layer air curtain and the air inside the product storage 902 to be appropriately cooled. Here, the reason why the amount of such hot air sucked into the inner-layer air curtain intake 921 in the OFF state is smaller than that in the ON state is presumed as below. When such an increased number of customers more frequently take out products from the showcase and cause disturbance of the outer-layer air curtain, the inner-layer air curtain more frequently gets involved into the disturbance of the outer-layer air curtain. As the inner-layer air curtain gets involved, the amount of the hot air flowing into the inner-layer air curtain becomes greater when the outer-layer air curtain is ON than when the outer-layer air curtain is OFF. It is presumed that the showcase using the ordinary dual air curtain illustrated in FIG. 1 also has this tendency.

Although FIG. 3 illustrates the power consumption of the showcase 900 using the simple dual air curtain, the power consumption of the showcase 800 using the ordinary dual air curtain presumably has a similar characteristic. To be more specific, also in the case of the showcase 800 using the ordinary dual air curtain, when the number of customers in the store is increased, an increased number of customers take products out from the showcase, and disturb the dual air curtain in the ON state so much that a more amount of the air outside the dual air curtain (the air in the selling space) is mixed with the air of the dual air curtain than when the outer-layer air curtain is OFF, which greatly increases the cooling load of the showcase 800 presumably.

To address the foregoing situation, a showcase according to a first aspect of the present disclosure includes: a casing having a front opening through which a product is picked up; a product storage located in the casing and including a shelf on which the product is displayed; a first airflow generator that sends air for a first air curtain to flow outside along the product storage; a second airflow generator that sends air for a second air curtain to flow outside along the first air curtain; and a controller that causes the first airflow generator to operate and causes the second airflow generator to reduce an output of the second airflow generator from an output at a first timing, upon arrival of a second timing when a break of the second air curtain due to disturbance is greater than a break of the second air curtain at the first timing.

Thus, the showcase causes the second airflow generator to reduce the output of the air for the second air curtain to accordingly reduce the amount of the air for the first air curtain getting involved in disturbance of the second air curtain, so that the showcase can reduce the amount of hot air flowing into the first air curtain. Hence, the showcase can reduce the increase of the cooling load due to disturbance.

Here, "reducing the output of the second airflow generator from the output at the first timing" includes not only the case of operating the second airflow generator with the output lower than that at the first timing, but also the case where the output of the second airflow generator is zero, that is, the second airflow generator is stopped.

In addition, the output of the first airflow generator at the second timing may be appropriately controlled relative to that at the first timing. For example, the output of the first airflow generator at the second timing may be increased from, kept equal to or reduced from the output at the first timing.

In a showcase according to a second aspect of the present disclosure, at the second timing, the controller in the above first aspect may cause the second airflow generator to reduce an output of the second airflow generator such that the output of the second airflow generator becomes lower than an output of the first airflow generator.

With this reduction of the output of the second airflow generator, the increase of the cooling load of the showcase due to disturbance can be reduced. Since the output of the first airflow generator is not reduced to the same level as the output of the second airflow generator is, the first air curtain continues cooling.

Here, the output of the first airflow generator at the second timing is appropriately controlled relative to that at the first timing within a range of an output reduction rate smaller than that of the second airflow generator. For example, the output of the first airflow generator at the second timing may be increased from, kept equal to, or reduced from that at the first timing within the range of the output reduction rate smaller than that of the second airflow generator.

In a showcase according to a third aspect of the present disclosure, at the second timing, the controller in the first or second aspect may cause the first airflow generator to reduce an output of the first airflow generator and an output of the second airflow generator lower from their respective outputs at the first timing.

With this reduction of the output of the second airflow generator, the increase of the cooling load of the showcase due to disturbance can be reduced. In addition, such reduction of the output of the first airflow generator makes it possible to decrease the power consumption of the showcase and also to reduce a temperature rise of the air for the first air curtain due to outside air getting into the first air curtain.

In a showcase according to a fourth aspect of the present disclosure, the controller in the second or third aspect may stop an output of the second airflow generator at the second timing.

In this case, the showcase stops the flow of the second air curtain, and thereby further reduces the amount of the first air curtain involved in disturbance of the second air curtain, so that the amount of the hot air flowing into the first air curtain can be further reduced. Consequently, the showcase can reduce the increase of the cooling load due to disturbance.

A showcase according to a fifth aspect of the present disclosure may be the showcase of any one of the first to fourth aspects in which a temperature of air for the second air curtain is higher than a temperature of air for the first air curtain.

In this case, the air for the second air curtain has a temperature higher than that of the air for the first air curtain, and the amount of such hot air for the second air curtain getting into the first air curtain is reduced. Hence, the showcase can reduce the increase of the cooling load due to disturbance.

According to a sixth aspect of the present disclosure, the showcase in any one of the first to fifth aspects may include an intake that sucks air for the first air curtain, and the second timing may be a timing when a temperature of air flowing into the intake is higher than a temperature at the first timing, for example.

With this, the showcase can reduce the increase of the cooling load at a high-temperature timing.

In a showcase according to a seventh aspect of the present disclosure, the showcase in any one of the first to sixth aspects may include an intake that sucks air for the first air curtain, and the second timing may be a timing when an enthalpy of air flowing into the intake is higher than an enthalpy at the first timing, for example.

With this, the showcase can reduce the increase of the cooling load at a high-enthalpy timing.

A showcase according to an eighth aspect of the present disclosure may be the showcase in any one of the first to seventh aspects in which the second timing is a timing during which a frequency of taking out products from the product storage is higher than a frequency at the first timing, for example.

With this, the showcase can reduce the increase of the cooling load at a timing having a high frequency of taking out products.

A showcase according to a ninth aspect of the present disclosure may be the showcase in any one of the first to eighth aspects in which the second timing is a timing during which the number of customers in a store equipped with the showcase is larger than the number of customers at the first timing, for example.

With this, the showcase can reduce the increase of the cooling load at a timing having a large number of customers.

A method of operating a showcase according to a tenth aspect of the present disclosure may include: sending air for a first air curtain by a first airflow generator; sending air for a second air curtain to flow outside along the first air curtain, by a second airflow generator; and keeping the first airflow generator operating and reducing an output of the second airflow generator from an output at a first timing, upon arrival of a second timing when a break of the second air curtain due to disturbance is greater than a break of the second air curtain at the first timing.

With this, a reduced amount of the air of the second air curtain containing the air outside the casing gets into the casing. Hence, the increase of the cooling load due to disturbance is reduced.

Note that these comprehensive or specific aspects may be each implemented as a system, a device, a method, an integrated circuit, a computer program, a non-transitory computer-readable record medium such as a CD-ROM, or any selective combination thereof.

Embodiments are described in details below with reference to the drawings. Note that the embodiments described below indicate comprehensive and specific examples. Numerical values, shapes, materials, elements, arrangement positions and connection conditions of the elements, steps, an order of the steps, and the like indicated in the embodiments below are examples, which are not intended at all to limit the present disclosure. Among the elements in the embodiments below, elements not mentioned in the independent claims, which indicate the most generic concept, are each described as an optional element.

For the sake of expressions, ordinal numbers such as first, second, and third are added to the elements and the like, but these ordinal numbers may be replaced with others, or removed.

(Embodiments)

Figure 4:
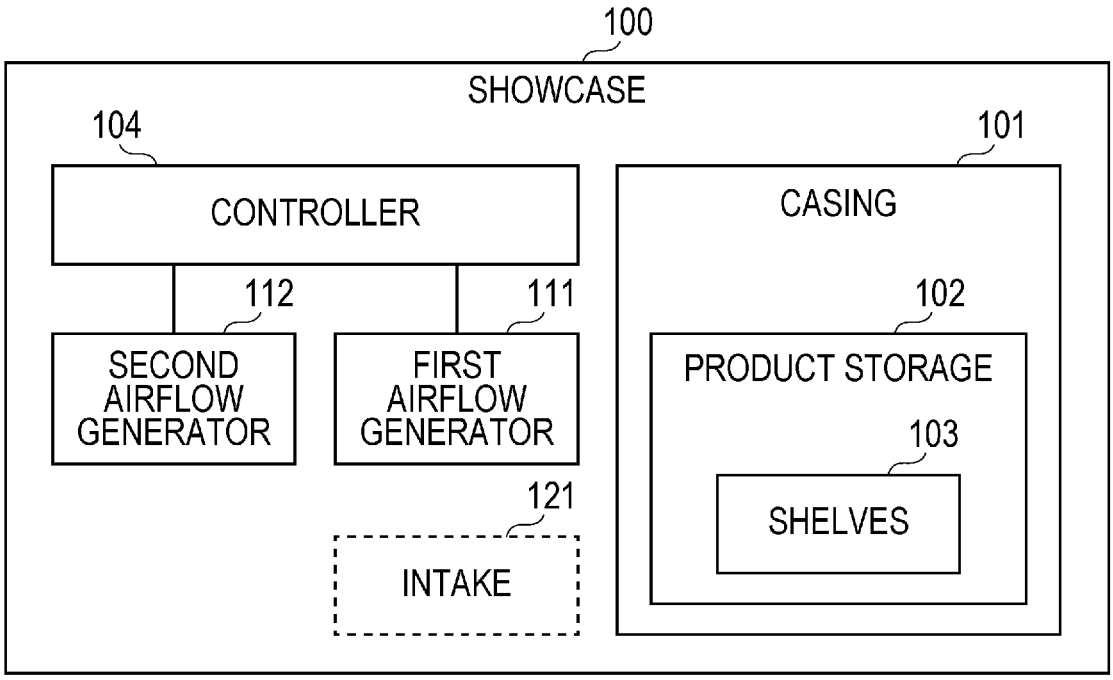
FIG. 4 is a block diagram that illustrates a configuration of a showcase in an embodiment.

FIG. 4 is a block diagram that illustrates a configuration of a showcase in the present embodiment. The showcase 100 illustrated in FIG. 4 includes a casing 101, a product storage 102, shelves 103, a controller 104, a first airflow generator 111, and a second airflow generator 112. The showcase 100 may further include an intake 121 as an optional element.

The casing 101 is an example of a casing of the present disclosure, and has an opening in a front face for taking out products. For example, the casing 101 is a housing of the showcase 100. The front face is the face on the front side of the casing 101 and is also the face on the front side of the showcase 100.

The product storage 102 is an example of a product storage of the present disclosure and is provided inside the casing 101. The product storage includes the shelves 103. The shelves 103 are an example of shelves of the present disclosure, and are for displaying the products.

The first airflow generator 111 is an example of a first airflow generator of the present disclosure, and sends the air for the first air curtain. For example, the first airflow generator 111 is a fan.

Here, the air for the first air curtain flows outside the product storage 102. For example, the air for the first air curtain flows so as to cover the opening of the casing 101. Note that the first air curtain corresponds to the inner-layer air curtain.

The second airflow generator 112 is an example of a second airflow generator of the present disclosure, and sends the air for the second air curtain. For example, the second airflow generator 112 is a fan.

Here, the air for the second air curtain flows outside the first air curtain. Specifically, the air for the second air curtain flows outside the product storage 102 and the first air curtain. For example, the air for the second air curtain flows outside the first air curtain outside the product storage 102 so as to cover the opening of the casing 101. Note that the second air curtain corresponds to the outer-layer air curtain.

The intake 121 is an example of an intake of the present disclosure, and sucks the air for the first air curtain. Specifically, the intake 121 sucks the air for the first air curtain flowing outside the product storage 102.

The controller 104 is an example of a controller of the present disclosure. The controller 104 keeps the first airflow generator 111 operating and stops the second airflow generator 112 upon arrival of a second timing when a break of the second air curtain due to disturbance is greater than that at a first timing.

For example, the first timing may be a timing when the break of the second air curtain due to disturbance is equal to or smaller than a reference level, and the second timing may be a timing when the break of the second air curtain due to disturbance is greater than the reference level.

The second timing when the break of the second air curtain due to disturbance is greater than that at the first timing may be a timing when a temperature of the air flowing into the intake 121 is higher than that at the first timing. For example, the first timing may be a timing when the temperature of the air flowing into the intake 121 is equal to or lower than a threshold, and the second timing may be a timing when the temperature of the air flowing into the intake 121 is equal to or higher than the threshold.

In particular, the second timing may be a timing when the temperature of the air flowing into the intake 121 is higher than that at the first timing in an operation with constant outputs of the first airflow generator 111 and the second airflow generator 112. For example, the first timing may be a timing when the temperature of the air flowing into the intake 121 is equal to or lower than the threshold in the operation with the constant outputs, and the second timing may be a timing when the temperature of the air flowing into the intake 121 is higher than the threshold in the operation with the constant outputs.

The second timing when the break of the second air curtain due to disturbance is greater than that at the first timing may be a timing when an enthalpy of the air flowing into the intake 121 is higher than that at the first timing. For example, the first timing may be a timing when the enthalpy of the air flowing into the intake 121 is equal to or lower than a threshold, and the second timing may be a timing when the enthalpy of the air flowing into the intake 121 is higher than the threshold.

In particular, the second timing may be a timing when the enthalpy of the air flowing into the intake 121 is higher than that at the first timing in an operation with the constant outputs of the first airflow generator 111 and the second airflow generator 112. For example, the first timing may be a timing when the enthalpy of the air flowing into the intake 121 is equal to or lower than the threshold in the operation with the constant outputs, and the second timing may be a timing when the enthalpy of the air flowing into the intake 121 is higher than the threshold in the operation with the constant outputs.

The second timing when the break of the second air curtain due to disturbance is greater than that at the first timing may be a timing when a frequency of taking out products from the product storage 102 is higher than that at the first timing. For example, the first timing may be a timing when the frequency of taking out products from the product storage 102 is equal to or lower than a threshold, and the second timing may be a timing when the frequency of taking out products from the product storage 102 is higher than the threshold.

The second timing when the break of the second air curtain due to disturbance is greater than that at the first timing may be a timing when the number of customers in the store equipped with the showcase 100 is larger than that at the first timing. For example, the first timing may be a timing when the number of customers in the store equipped with the showcase 100 is equal to or smaller than a threshold, and the second timing may be a timing when the number of customers in the store equipped with the showcase 100 is larger than the threshold.

The first timing and the second timing may be a first time period and a second time period, respectively. Specifically, the second timing may be a time period when the break of the second air curtain due to disturbance is greater than that in a first time period set as the first timing.

The controller 104 controls the first airflow generator 111 and the second airflow generator 112. The controller 104 may be a computer and may include an arithmetic processor and a memory storing a control program. The arithmetic processor in the controller 104 may be an MPU or a CPU. The memory in the controller 104 may be volatile or non-volatile. The controller 104 may be formed of a single controller that performs centralized control, or formed of multiple controllers that perform decentralized control by cooperating with each other.

Figure 5:
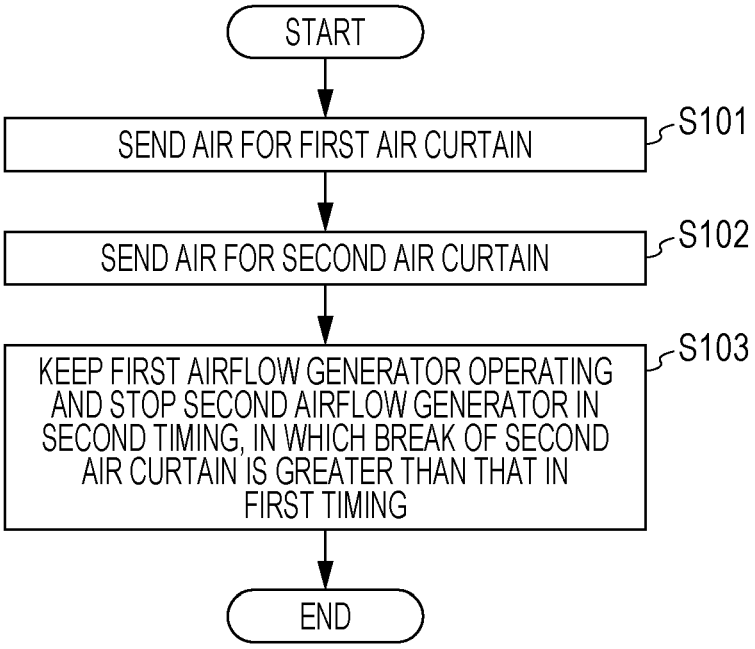
FIG. 5 is a flowchart that illustrates an operation of the showcase in the embodiment.

FIG. 5 is a flowchart that illustrates an operation of the showcase 100 illustrated in FIG. 4. For example, the showcase 100 illustrated in FIG. 4 performs the operation illustrated in FIG. 5.

Specifically, the first airflow generator 111 sends the air for the first air curtain (S101). The second airflow generator 112 sends the air for the second air curtain (S102). Then, the controller 104 keeps the first airflow generator 111 operating and stops the second airflow generator 112 at the second timing when the break of the second air curtain is greater than that at the first timing (S103).

Accordingly, the showcase 100 makes it possible that a reduced amount of the air for the second air curtain containing the air from outside the casing 101 is sucked into the intake 121 for the first air curtain. Thus, the showcase 100 can reduce the increase of the cooling load due to disturbance.

The controller 104 may cause the first airflow generator to reduce the output of the first airflow generator 111 at the second timing. In this state, the air for the first air curtain sucked into the intake 121 is cooled for a longer time. Thus, although the temperature of the air for the first air curtain flowing from the cooler increases when the hot outside air flows into the first air curtain from the outside, this temperature increase can be reduced.

Figure 6:
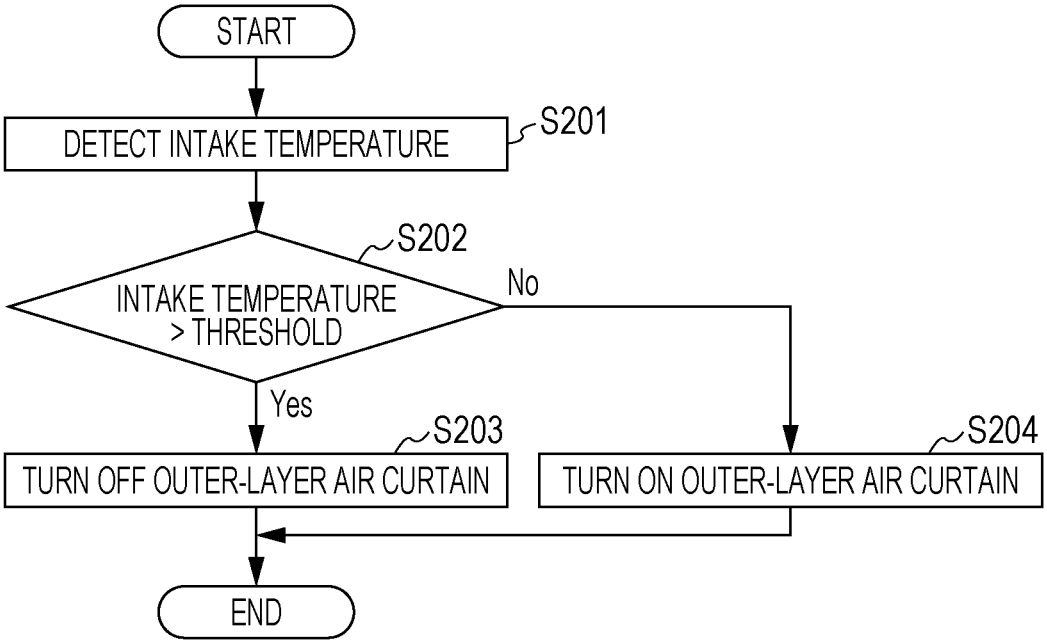
FIG. 6 is a flowchart that illustrates an example of an operation of a controller in the embodiment.

FIG. 6 is a flowchart that illustrates an example of an operation of the controller 104 in the showcase 100 illustrated in FIG. 4. For example, the controller 104 in the showcase 100 illustrated in FIG. 4 performs the operation illustrated in FIG. 6.

First, the controller 104 detects an intake temperature, which is the temperature of the air flowing into the intake 121 (S201). The controller 104 may detect the intake temperature using a sensor or the like. Next, the controller 104 determines whether the intake temperature is higher than a threshold (S202).

When the intake temperature is higher than the threshold (Yes in S202), the controller 104 turns off the outer-layer air curtain (S203). Specifically, in this step, the controller 104 keeps the first airflow generator 111 sending the air for the first air curtain, and stops the second airflow generator 112 from sending the air for the second air curtain.

On the other hand, when the intake temperature is not higher than the threshold (No in S202), that is, when the intake temperature is equal to or lower than the threshold, the controller 104 keeps the outer-layer air curtain in the ON state (S204). Specifically, in this step, the controller 104 keeps the operation of both the first airflow generator 111 sending the air for the first air curtain, and the second airflow generator 112 sending the air for the second air curtain.

With the above operation, the controller 104 keeps the first airflow generator 111 operating and stops the second airflow generator 112 upon arrival of the second timing when the temperature of the air flowing into the intake 121 is higher than that at the first timing. At the second timing, the break of the second air curtain due to disturbance is supposed to be greater than that at the first timing. For this reason, the controller 104 performs the above operation to keep the first airflow generator 111 operating and stop the second airflow generator 112 at the second timing when the break of the second air curtain due to disturbance is greater than that at the first timing.

In the example in FIG. 6, the second timing is the timing having a high temperature of the air flowing into the intake 121. Instead, the second timing may be any of the timing having a high enthalpy of the air flowing into the intake 121, the timing having a high frequency of taking out products from the product storage 102, and the timing having a large number of customers in the store equipped with the showcase 100, as described above.

Figure 7:
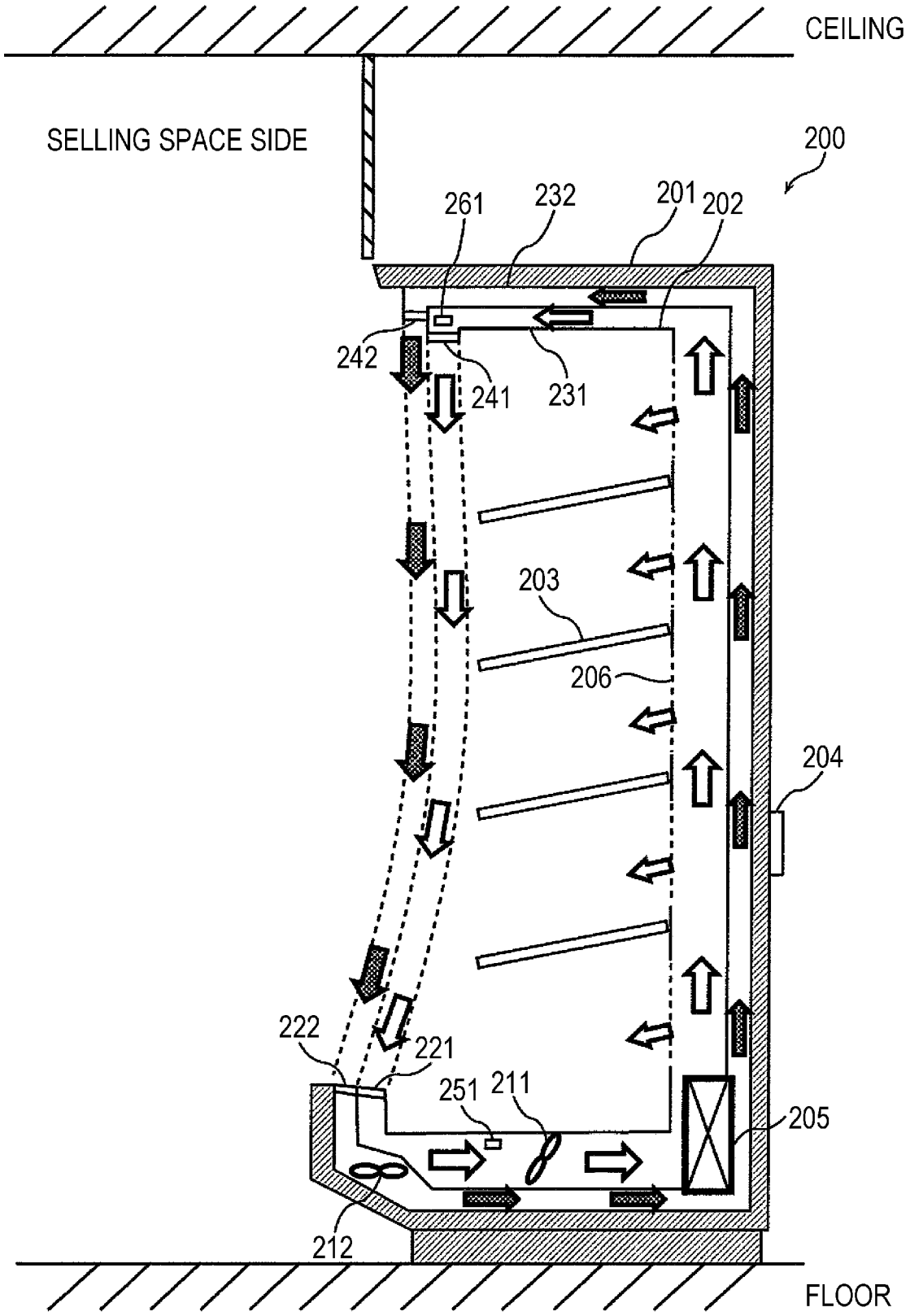
FIG. 7 is a configuration diagram that illustrates a first specific example of the showcase in the embodiment.

FIG. 7 is a configuration diagram that illustrates a first specific example of the showcase 100 illustrated in FIG. 4. A showcase 200 illustrated in FIG. 7 is an open showcase installed in a store and the like, which uses the ordinary dual air curtain, not the simple dual air curtain. In other words, FIG. 7 illustrates an example where the showcase 100 illustrated in FIG. 4 is applied to the showcase 200 using the ordinary dual air curtain.

The showcase 200 includes elements such as a casing 201, a product storage 202, shelves 203, a controller 204, a cooler 205, slits 206, an inner-layer circulation fan 211, an outer-layer circulation fan 212, an inner-layer air curtain intake 221, an outer-layer air curtain intake 222, an inner-layer circulation duct 231, an outer-layer circulation duct 232, an inner-layer air curtain outlet 241, an outer-layer air curtain outlet 242, an intake sensor 251, and an outlet sensor 261.

The showcase 200, the casing 201, the product storage 202, the shelves 203, the controller 204, the inner-layer circulation fan 211, the outer-layer circulation fan 212, and the inner-layer air curtain intake 221 in FIG. 7 are examples of the showcase 100, the casing 101, the product storage 102, the shelves 103, the controller 104, the first airflow generator 111, the second airflow generator 112, and the intake 121, respectively, in FIG. 4.

The casing 201 has an opening in a front face for taking out products. This front face is the front face of the casing 201 and is also the front face of the showcase 200. For example, the casing 201 is a housing of the showcase 200.

The product storage 202 is provided inside the casing 201. The product storage 202 includes the shelves 203. The shelves 203 are for displaying the products. Specifically, the products are placed on the shelves 203.

The inner-layer circulation fan 211 sends the air for the inner-layer air curtain to circulate the air for the inner-layer air curtain. Here, the inner-layer air curtain corresponds to the first air curtain. The air for the inner-layer air curtain flowing outside the product storage 202 forms the inner-layer air curtain.

For example, the air for the inner-layer air curtain flows from the inner-layer air curtain outlet 241, flows so as to cover the opening of the casing 201, and is sucked into the inner-layer air curtain intake 221. Then, the air for the inner-layer air curtain is sent from the inner-layer air curtain intake 221 through the inner-layer circulation duct 231 to the inner-layer air curtain outlet 241.

The inner-layer circulation fan 211 sends the air for the inner-layer air curtain in the inner-layer circulation duct 231 to circulate the air for the inner-layer air curtain as described above.

The outer-layer circulation fan 212 sends the air for the outer-layer air curtain to circulate the air for the outer-layer air curtain. Here, the outer-layer air curtain corresponds to the second air curtain. The air for the outer-layer air curtain flowing outside the inner-layer air curtain forms the outer-layer air curtain.

For example, the air for the outer-layer air curtain flows from the outer-layer air curtain outlet 242, flows outside the inner-layer air curtain outside the product storage 202 so as to cover the opening of the casing 201, and is sucked into the outer-layer air curtain intake 222. Then, the air for the outer-layer air curtain is sent from the outer-layer air curtain intake 222 through the outer-layer circulation duct 232 to the outer-layer air curtain outlet 242.

The outer-layer circulation fan 212 sends the air for the outer-layer air curtain in the outer-layer circulation duct 232 to circulate the air for the outer-layer air curtain as described above.

The inner-layer circulation fan 211 and the outer-layer circulation fan 212 may respectively send the air for the inner-layer air curtain and the air for the outer-layer air curtain such that the flow speeds of the air for the inner-layer air curtain and the air for the outer-layer air curtain differ from each other. For example, the inner-layer circulation fan 211 and the outer-layer circulation fan 212 respectively send the air for the inner-layer air curtain and the air for the outer-layer air curtain such that the flow speed of the air for the inner-layer air curtain is faster than that of the air for the outer-layer air curtain.

With this, the showcase 200 can appropriately reduce the amount of the air getting into the product storage 202 from the outside.

The inner-layer air curtain outlet 241 ejects the air for the inner-layer air curtain. The outer-layer air curtain outlet 242 ejects the air for the outer-layer air curtain. As a result, the air for the inner-layer air curtain and the air for the outer-layer air curtain flow so as to cover the opening of the casing 201, thereby forming the dual air curtain.

The inner-layer air curtain intake 221 sucks the air for the inner-layer air curtain. The outer-layer air curtain intake 222 sucks the air for the outer-layer air curtain. The inner-layer circulation duct 231 guides the air for the inner-layer air curtain from the inner-layer air curtain intake 221 to the inner-layer air curtain outlet 241. The outer-layer circulation duct 232 guides the air for the outer-layer air curtain from the outer-layer air curtain intake 222 to the outer-layer air curtain outlet 242.

The cooler 205 cools both the air for the inner-layer air curtain and the air for the outer-layer air curtain. Specifically, the cooler 205 cools the air for the inner-layer air curtain in the inner-layer circulation duct 231, and cools the air for the outer-layer air curtain in the outer-layer circulation duct 232. For example, the cooler 205 is a freezer including a compressor and the like to cool the air in accordance with the principle of heat pump.

The slits 206 are provided on a back panel of the product storage 202. The air cooled by the cooler 205 is sent from the inner-layer circulation duct 231 through the slits 206 to the inside of the product storage 202. With this, the inside of the product storage 202 is cooled.

The intake sensor 251 is a sensor for detecting the intake temperature, which is a temperature of the air flowing into the inner-layer air curtain intake 221. For example, the intake sensor 251 is a thermometer which is disposed in or near the inner-layer air curtain intake 221 and detects the temperature of the air in or near the inner-layer air curtain intake 221 as the intake temperature.

In FIG. 7, the position of the intake sensor 251 disposed in the inner-layer circulation duct 231 is a position where the air for the inner-layer air curtain flows before entering the inner-layer circulation fan 211. Instead, the intake sensor 251 may be disposed at a position where the air for the inner-layer air curtain flows after leaving the inner-layer circulation fan 211. In the inner-layer circulation duct 231, the intake sensor 251 may be disposed at any position upstream of the position where the cooler 205 cools the air.

The intake sensor 251 may further detect an intake humidity, which is a humidity of the air flowing into the inner-layer air curtain intake 221. In other words, the intake sensor 251 may be a thermo-hygrometer and detect the humidity of the air in or near the inner-layer air curtain intake 221 as the intake humidity.

The outlet sensor 261 is a sensor for detecting an outlet temperature, which is a temperature of the air to flow out from the inner-layer air curtain outlet 241. For example, the outlet sensor 261 is a thermometer disposed in or near the inner-layer air curtain outlet 241 and detects the temperature of the air in or near the inner-layer air curtain outlet 241 as the outlet temperature. In the inner-layer circulation duct 231, the outlet sensor 261 may be disposed at any position downstream of the position where the cooler 205 cools the air for the inner-layer air curtain.

The outlet sensor 261 may further detect an outlet humidity, which is a humidity of the air to flow out from the inner-layer air curtain outlet 241. In other words, the outlet sensor 261 may be a thermo-hygrometer and detect the humidity of the air in or near the inner-layer air curtain outlet 241 as the outlet humidity.

The controller 204 keeps the inner-layer circulation fan 211 operating and stops the outer-layer circulation fan 212 upon arrival of the second timing when the break of the outer-layer air curtain due to disturbance is greater than that at the first timing. For example, the controller 204 is communicatively connected to the inner-layer circulation fan 211, the outer-layer circulation fan 212, the intake sensor 251, the outlet sensor 261, and the like via wired or wireless lines.

The controller 204 controls an operation of the inner-layer circulation fan 211 and the outer-layer circulation fan 212 via the communication to operate them. Also, the controller 204 controls the operation of the inner-layer circulation fan 211 and the outer-layer circulation fan 212 via the communication to keep the inner-layer circulation fan 211 operating and stop the outer-layer circulation fan 212 at the second timing when the break of the outer-layer air curtain is great.

The second timing may be a timing when the temperature of the air flowing into the inner-layer air curtain intake 221 is higher than that at the first timing. For example, the controller 204 may periodically detect the intake temperature by periodically receiving the intake temperature from the intake sensor 251. Then, the controller 204 may stop the outer-layer circulation fan 212 at the second timing when the intake temperature is higher than that at the first timing.

As the temperature of the air flowing into the inner-layer air curtain intake 221, a temperature relative to the temperature of the air to flow out from the inner-layer air curtain outlet 241 may be used. For example, the controller 204 may periodically detect the intake temperature and the outlet temperature by periodically receiving the intake temperature and the outlet temperature from the intake sensor 251 and the outlet sensor 261. Then, the controller 204 may stop the outer-layer circulation fan 212 at the second timing when the intake temperature minus the outlet temperature is higher than that at the first timing.

In particular, the second timing may be a timing when the temperature of the air flowing into the inner-layer air curtain intake 221 is higher than that at the first timing in the operation with the constant outputs of the inner-layer circulation fan 211, the outer-layer circulation fan 212, and the cooler 205. In other words, the controller 204 may stop the outer-layer circulation fan 212 at the second timing when the temperature of the air flowing into the inner-layer air curtain intake 221 is higher in the operation with the constant outputs.

The second timing may be a timing when an enthalpy of the air flowing into the inner-layer air curtain intake 221 is higher than that at the first timing.

For example, the controller 204 may periodically detect the intake temperature and the intake humidity by periodically receiving the intake temperature and the intake humidity from the intake sensor 251. Based on the intake temperature and the intake humidity, the controller 204 may derive the enthalpy of the air flowing into the inner-layer air curtain intake 221 as an intake enthalpy. The controller 204 may stop the outer-layer circulation fan 212 at the second timing when the intake enthalpy is higher than that at the first timing.

As the enthalpy of the air flowing into the inner-layer air curtain intake 221, an enthalpy relative to an enthalpy of the air to flow out from the inner-layer air curtain outlet 241 may be used.

For example, the controller 204 may periodically detect the intake temperature, the intake humidity, the outlet temperature, and the outlet humidity by periodically receiving the intake temperature, the intake humidity, the outlet temperature, and the outlet humidity from the intake sensor 251 and the outlet sensor 261.

Based on the intake temperature and the intake humidity, the controller 204 may derive the enthalpy of the air flowing into the inner-layer air curtain intake 221 as the intake enthalpy. Based on the outlet temperature and the outlet humidity, the controller 204 may derive the enthalpy of the air to flow out from the inner-layer air curtain outlet 241 as an outlet enthalpy. The controller 204 may stop the outer-layer circulation fan 212 at the second timing when the intake enthalpy minus the outlet enthalpy is higher than that at the first timing.

In particular, the second timing may be a timing when the enthalpy of the air flowing into the inner-layer air curtain intake 221 is higher than that at the first timing in the operation with the constant outputs of the inner-layer circulation fan 211, the outer-layer circulation fan 212, and the cooler 205. In other words, the controller 204 may stop the outer-layer circulation fan 212 at the second timing when the enthalpy of the air flowing into the inner-layer air curtain intake 221 is higher in the operation with the constant outputs.

The second timing may be a timing when the frequency of taking out products from the product storage 202 is higher than that at the first timing. For example, the controller 204 may obtain the frequency of taking out products from the product storage 202 by receiving a frequency of purchasing products from a cash register in the store. The controller 204 may stop the outer-layer circulation fan 212 at the second timing when the frequency of taking out products from the product storage 202 is higher than that at the first timing.

The second timing may be a timing predetermined as a timing when the frequency of taking out products from the product storage 202 is estimated to be higher than that at the first timing. For example, the second timing may be predetermined based on the information in the cash register in the store.

The second timing may be a timing when the number of customers in the store equipped with the showcase 200 is larger than that at the first timing. For example, the controller 204 may estimate the number of customers in the store equipped with the showcase 200 by receiving an open-close count of an entrance door of the store from an opening-closing sensor installed at the door, or receiving the number of purchasers from the cash register in the store. The controller 204 may stop the outer-layer circulation fan 212 at the second timing when the number of customers in the store is larger than that at the first timing.

The second timing may be a timing predetermined as a timing when the number of customers in the store equipped with the showcase 200 is estimated to be larger than that at the first timing. For example, the second timing may be predetermined based on the open-close count, which is obtained from the opening-closing sensor installed at the door of the store, or the number of purchasers, which is obtained from the cash register in the store.

As described above, the controller 204 keeps the inner-layer circulation fan 211 operating and stops the outer-layer circulation fan 212 at the second timing when the break of the outer-layer air curtain due to disturbance is greater than that at the first timing.

As a result, the showcase 200 can reduce the amount of the air outside the casing 201 getting into the product storage 202 due to disturbance. To be more specific, the showcase 200 can prevent the air outside the casing 201 from getting into the outer-layer air curtain intake 222, the inner-layer air curtain intake 221 and the like due to disturbance. Hence, the showcase 200 can reduce the increase of the cooling load of the showcase 200 due to the air from the outside.

At the second timing, the controller 204 may reduce the output of the inner-layer circulation fan 211. With this, the air flows more slowly in the inner-layer circulation duct 231, and accordingly the cooler 205 is allowed to cool the air by using a longer time. Thus, although the temperature of the air of the inner-layer air curtain flowing from the cooler 205 increases if the air outside the casing 201 flows into the inner-layer air curtain, the temperature increase can be reduced. Hence, the showcase 200 can reduce the increase of the cooling load due to disturbance.

In FIG. 7, the controller 204 is mounted on the casing 201. Instead, the controller 204 may be mounted inside the casing 201, or may be installed away from the casing 201. The controller 204 may be included in both or one of the inner-layer circulation fan 211 and the outer-layer circulation fan 212. In other words, the controller 204 may be incorporated into both or one of the inner-layer circulation fan 211 and the outer-layer circulation fan 212.

For example, in the case of using the enthalpy, the controller 204 derives the enthalpy from the temperature and the humidity in accordance with a predetermined relationship among the temperature, the humidity, and the enthalpy. Specifically, in the case of using the enthalpy, the controller 204 may derive the enthalpy from the temperature and the humidity with reference to a psychrometric chart, which indicates a relationship among the temperature, the humidity, and the enthalpy. Otherwise, the controller 204 may derive the enthalpy from the temperature and the humidity in accordance with a predetermined relational expression of the temperature, the humidity, and the enthalpy.

To be more specific, the controller 204 may obtain a dry-bulb temperature as the temperature and an absolute humidity as the humidity, and may derive the enthalpy using the relational expression below, which is an example of the predetermined relational expression of the temperature, the humidity, and the enthalpy:

enthalpy=mean specific heat of dry air×dry-bulb temperature+(evaporative latent heat of water at 0° c.+mean specific heat of water vapor×dry-bulb temperature)×absolute humidity.

Each of the intake sensor 251 and the outlet sensor 261 may be an enthalpy sensor for detecting the enthalpy. Then, the controller 204 may periodically detect the enthalpies by periodically receiving the enthalpies from the intake sensor 251 and the outlet sensor 261.

The elements illustrated in FIG. 7 may be optionally and selectively added to the showcase 100 illustrated in FIG. 4. For example, the showcase 200 may not include elements such as the cooler 205, the inner-layer circulation duct 231, and the outer-layer circulation duct 232 not corresponding to the elements of the showcase 100, among the elements illustrated in FIG. 7. These elements may be provided to the store or the like equipped with the showcase 200.

When only the intake sensor 251, out of the intake sensor 251 and the outlet sensor 261, is used for detecting the temperature or the enthalpy, the showcase 200 may not include the outlet sensor 261. When the second timing is defined as the timing having a high frequency of taking out products, or as the timing having a large number of customers in the store, the showcase 200 may not include both the intake sensor 251 and the outlet sensor 261.

Figure 8:
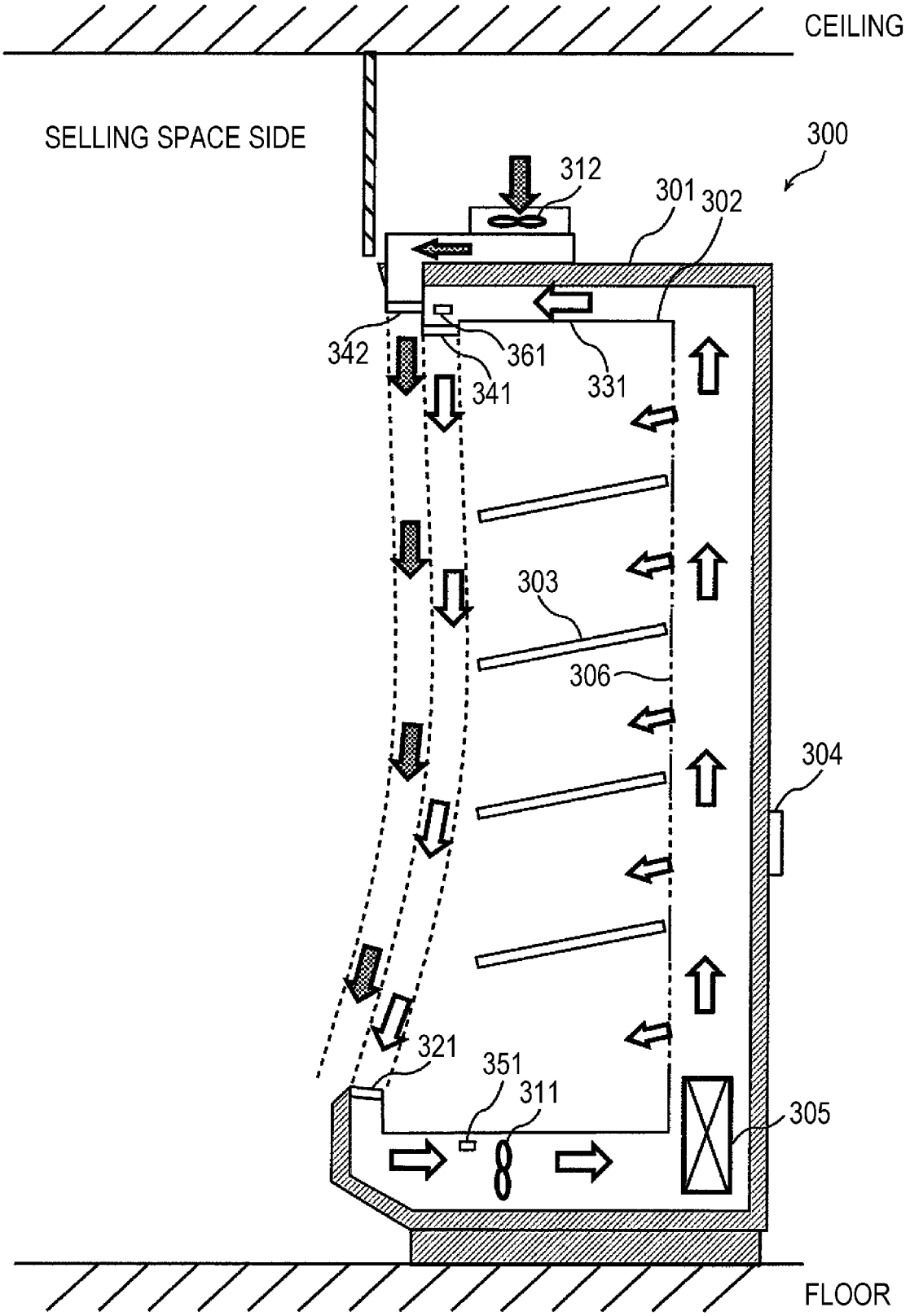
FIG. 8 is a configuration diagram that illustrates a second specific example of the showcase in the embodiment.

FIG. 8 is a configuration diagram that illustrates a second specific example of the showcase 100 illustrated in FIG. 4. A showcase 300 illustrated in FIG. 8 is an open showcase installed in a store or the like, and uses a simple dual air curtain. In other words, FIG. 8 illustrates an example where the showcase 100 illustrated in FIG. 4 is applied to the showcase 300 using the simple dual air curtain.

The showcase 300 includes elements such as a casing 301, a product storage 302, shelves 303, a controller 304, a cooler 305, slits 306, a cold air circulation fan 311, a non-cold air circulation fan 312, an inner-layer air curtain intake 321, a cold air circulation duct 331, an inner-layer air curtain outlet 341, an outer-layer air curtain outlet 342, an intake sensor 351, and an outlet sensor 361.

The showcase 300, the casing 301, the product storage 302, the shelves 303, the controller 304, the cold air circulation fan 311, the non-cold air circulation fan 312, and the inner-layer air curtain intake 321 in FIG. 8 are examples of the showcase 100, the casing 101, the product storage 102, the shelves 103, the controller 104, the first airflow generator 111, the second airflow generator 112, and the intake 121, respectively, in FIG. 4.

The casing 301 has an opening in a front face for taking products out. This front face is the front face of the casing 301 and is also the front face of the showcase 300. For example, the casing 301 is a housing of the showcase 300.

The product storage 302 is provided inside the casing 301. The product storage 302 includes the shelves 303. The shelves 303 are for displaying the products. Specifically, the products are placed on the shelves 303.

The cold air circulation fan 311 sends the air for the inner-layer air curtain to circulate the air for the inner-layer air curtain. Here, the inner-layer air curtain corresponds to the first air curtain. The air for the inner-layer air curtain flowing outside the product storage 302 forms the inner-layer air curtain.

For example, the air for the inner-layer air curtain flows from the inner-layer air curtain outlet 341, flows so as to cover the opening of the casing 301, and is sucked into the inner-layer air curtain intake 321. Then, the air for the inner-layer air curtain is sent from the inner-layer air curtain intake 321 through the cold air circulation duct 331 to the inner-layer air curtain outlet 341.

The cold air circulation fan 311 sends the air for the inner-layer air curtain in the cold air circulation duct 331 to circulate the air for the inner-layer air curtain as described above. Note that the air for the inner-layer air curtain is cooled. In other words, the cold air is used as the air for the inner-layer air curtain.

The non-cold air circulation fan 312 sends the air for the outer-layer air curtain. Here, the outer-layer air curtain corresponds to the second air curtain. The air for the outer-layer air curtain flowing outside the inner-layer air curtain forms the outer-layer air curtain.

For example, the air for the outer-layer air curtain flows from the outer-layer air curtain outlet 342, and flows outside the inner-layer air curtain outside the product storage 302 so as to cover the opening of the casing 301.

The non-cold air circulation fan 312 sends the air for the outer-layer air curtain to circulate the air for the outer-layer air curtain as described above. Note that the air for the outer-layer air curtain is not cooled. In other words, the non-cold air is used as the air for the outer-layer air curtain.

The cold air circulation fan 311 and the non-cold air circulation fan 312 may respectively send the air for the inner-layer air curtain and the air for the outer-layer air curtain such that the flow speeds of the air for the inner-layer air curtain and the air for the outer-layer air curtain differ from each other. For example, the cold air circulation fan 311 and the non-cold air circulation fan 312 respectively send the air for the inner-layer air curtain and the air for the outer-layer air curtain such that the flow speed of the air for the inner-layer air curtain is faster than that of the air for the outer-layer air curtain.

Accordingly, the showcase 300 can appropriately reduce the amount of the air getting into the product storage 302 from the outside.

The inner-layer air curtain outlet 341 ejects the air for the inner-layer air curtain. The outer-layer air curtain outlet 342 ejects the air for the outer-layer air curtain. As a result, the air for the inner-layer air curtain and the air for the outer-layer air curtain flow so as to cover the opening of the casing 301, thereby forming the dual air curtain.

The inner-layer air curtain intake 321 sucks the air for the inner-layer air curtain. The cold air circulation duct 331 guides the air for the inner-layer air curtain from the inner-layer air curtain intake 321 to the inner-layer air curtain outlet 341.

The cooler 305 cools the air for the inner-layer air curtain. Specifically, the cooler 305 cools the air for the inner-layer air curtain in the cold air circulation duct 331. For example, the cooler 305 is a freezer including a compressor and the like and cools the air in accordance with the principle of heat pump.

The slits 306 are provided on a back panel of the product storage 302. The air cooled by the cooler 305 is sent from the cold air circulation duct 331 through the slits 306 to the inside of the product storage 302. With this, the inside of the product storage 302 is cooled.

The intake sensor 351 is a sensor for detecting an intake temperature, which is a temperature of the air flowing into the inner-layer air curtain intake 321. For example, the intake sensor 351 is a thermometer disposed in or near the inner-layer air curtain intake 321 and detects a temperature of the air in or near the inner-layer air curtain intake 321 as the intake temperature.

In FIG. 8, the intake sensor 351 in the cold air circulation duct 331 is disposed at a position where the air for the inner-layer air curtain flows before entering the cold air circulation fan 311. Instead, the intake sensor 351 may be disposed at a position where the air for the inner-layer air curtain flows after leaving the cold air circulation fan 311. In the cold air circulation duct 331, the intake sensor 351 may be disposed at any position upstream of the position where the cooler 305 cools the air.

The intake sensor 351 may further detect an intake humidity, which is a humidity of the air flowing into the inner-layer air curtain intake 321. In other words, the intake sensor 351 may be a thermo-hygrometer and detect the humidity of the air in or near the inner-layer air curtain intake 321 as the intake humidity.

The outlet sensor 361 is a sensor for detecting an outlet temperature, which is a temperature of the air to flow out from the inner-layer air curtain outlet 341. For example, the outlet sensor 361 is a thermometer disposed in or near the inner-layer air curtain outlet 341 for detecting the temperature of the air in or near the inner-layer air curtain outlet 341 as the outlet temperature. In the cold air circulation duct 331, the outlet sensor 361 may be disposed at any position downstream of the position where the cooler 305 cools the air.

The outlet sensor 361 may further detect an outlet humidity, which is a humidity of the air to flow out from the inner-layer air curtain outlet 341. In other words, the outlet sensor 361 may be a thermo-hygrometer and detect the humidity of the air in or near the inner-layer air curtain outlet 341 as the outlet humidity.

The controller 304 keeps the cold air circulation fan 311 operating and stops the non-cold air circulation fan 312 upon arrival of the second timing when the break of the outer-layer air curtain due to disturbance is greater than that at the first timing. For example, the controller 304 is communicatively connected to the cold air circulation fan 311, the non-cold air circulation fan 312, the intake sensor 351, the outlet sensor 361 and the like via wired or wireless lines.

The controller 304 controls an operation of the cold air circulation fan 311 and the non-cold air circulation fan 312 via the communication to operate them. Also, the controller 304 controls the operation of the cold air circulation fan 311 and the non-cold air circulation fan 312 via the communication to keep the cold air circulation fan 311 operating and stop the non-cold air circulation fan 312 at the second timing when the break of the outer-layer air curtain is greater.

The second timing may be a timing when the temperature of the air flowing into the inner-layer air curtain intake 321 is higher than that at the first timing. For example, the controller 304 may periodically detect the intake temperature by periodically receiving the intake temperature from the intake sensor 351. The controller 304 may stop the non-cold air circulation fan 312 at the second timing when the intake temperature is higher than that at the first timing.

As the temperature of the air flowing into the inner-layer air curtain intake 321, a temperature relative to the temperature of the air to flow out from the inner-layer air curtain outlet 341 may be used. For example, the controller 304 may periodically detect the intake temperature and the outlet temperature by periodically receiving the intake temperature and the outlet temperature from the intake sensor 351 and the outlet sensor 361. The controller 304 may stop the non-cold air circulation fan 312 at the second timing when the intake temperature minus the outlet temperature is higher than that at the first timing.

In particular, the second timing may be a timing when the temperature of the air flowing into the inner-layer air curtain intake 321 is higher than that at the first timing in the operation with the constant outputs of the cold air circulation fan 311, the non-cold air circulation fan 312, and the cooler 305. The controller 304 may stop the non-cold air circulation fan 312 at the second timing when the temperature of the air flowing into the inner-layer air curtain intake 321 is higher in the operation with the constant outputs.

The second timing may be a timing when an enthalpy of the air flowing into the inner-layer air curtain intake 321 is higher than that at the first timing.

For example, the controller 304 may periodically detect the intake temperature and the intake humidity by periodically receiving the intake temperature and the intake humidity from the intake sensor 351. Based on the intake temperature and the intake humidity, the controller 304 may derive the enthalpy of the air flowing into the inner-layer air curtain intake 321 as an intake enthalpy. The controller 304 may stop the non-cold air circulation fan 312 at the second timing when the intake enthalpy is higher than that at the first timing.

As the enthalpy of the air flowing into the inner-layer air curtain intake 321, an enthalpy relative to an enthalpy of the air to flow out from the inner-layer air curtain outlet 341 may be used.

For example, the controller 304 may periodically detect the intake temperature, the intake humidity, the outlet temperature, and the outlet humidity by periodically receiving the intake temperature, the intake humidity, the outlet temperature, and the outlet humidity from the intake sensor 351 and the outlet sensor 361.

Based on the intake temperature and the intake humidity, the controller 304 may derive the enthalpy of the air flowing into the inner-layer air curtain intake 321 as the intake enthalpy. Based on the outlet temperature and the outlet humidity, the controller 304 may derive the enthalpy of the air to flow out from the inner-layer air curtain outlet 341 as an outlet enthalpy. The controller 304 may stop the non-cold air circulation fan 312 at the second timing when the intake enthalpy minus the outlet enthalpy is higher than that at the first timing.

In particular, the second timing may be a timing when the enthalpy of the air flowing into the inner-layer air curtain intake 321 is higher than that at the first timing in the operation with the constant outputs of the cold air circulation fan 311, the non-cold air circulation fan 312, and the cooler 305. The controller 304 may stop the non-cold air circulation fan 312 at the second timing when the enthalpy of the air flowing into the inner-layer air curtain intake 321 is higher in the operation with the constant outputs.

The second timing may be a timing when the frequency of taking out products from the product storage 302 is higher than that at the first timing. For example, the controller 304 may obtain the frequency of taking out products from the product storage 302 by receiving a frequency of purchasing products from a cash register in the store. The controller 304 may stop the non-cold air circulation fan 312 at the second timing when the frequency of taking out products from the product storage 302 is higher than that at the first timing.

The second timing may be a timing predetermined as a timing when the frequency of taking out products from the product storage 302 is estimated to be higher than that at the first timing. For example, the second timing may be predetermined based on the information in the cash register in the store.

The second timing may be a timing when the number of customers in the store equipped with the showcase 300 is larger than that at the first timing. For example, the controller 304 may estimate the number of customers in the store equipped with the showcase 300 by receiving an open-close count of an entrance door of the store from an opening-closing sensor installed at the door, or receiving the number of purchasers from the cash register in the store. The controller 304 may stop the non-cold air circulation fan 312 at the second timing when the number of customers in the store is larger than that at the first timing.

The second timing may be a timing predetermined as a timing when the number of customers in the store equipped with the showcase 300 is estimated to be larger than that at the first timing. For example, the second timing may be predetermined based on the open-close count obtained from the opening-closing sensor installed at the door of the store, or the number of purchasers obtained from the cash register in the store.

As described above, the controller 304 keeps the cold air circulation fan 311 operating and stops the non-cold air circulation fan 312 at the second timing when the break of the outer-layer air curtain due to disturbance is greater than that at the first timing.

As a result, the showcase 300 makes it possible that a reduced amount of the air of the outer-layer air curtain containing the air from outside the casing 301 gets into the casing 301 due to disturbance. Specifically, the showcase 300 makes it possible that a reduced amount of the air of the outer-layer air curtain containing the air from outside the casing 301 gets into the inner-layer air curtain intake 321 and the like due to disturbance. Hence, the increase of the cooling load of the showcase 300 due to the air from the outside can be reduced.

In particular, the showcase 300 using the simple dual air curtain uses the air outside the casing 301 to form the outer-layer air curtain. At the second timing when the break of the outer-layer air curtain is greater, the air of the outer-layer air curtain or the outside air is highly likely to get into the inner-layer air curtain intake 321. In this regard, the showcase 300 can appropriately reduce the amount of the outside air getting into the inner-layer air curtain intake 321 by turning off the outer-layer air curtain at the second timing when the break of the outer-layer air curtain is greater.

At the second timing, the controller 304 may reduce the output of the cold air circulation fan 311. This makes the flow speed of the air in the cold air circulation duct 331 lower, and allows the cooler 305 to cool the air by using a longer time. Thus, although the temperature of the air for the inner-layer air curtain flowing from the cooler 305 increases if the air outside the casing 301 flows into the inner-layer air curtain, the temperature increase can be reduced. Hence, the showcase 300 can reduce the increase of the cooling load due to disturbance.

In FIG. 8, the controller 304 is mounted on the casing 301. Instead, the controller 304 may be mounted inside the casing 301, or may be installed away from the casing 301. The controller 304 may be included in both or one of the cold air circulation fan 311 and the non-cold air circulation fan 312. In other words, the controller 304 may be incorporated into both or one of the cold air circulation fan 311 and the non-cold air circulation fan 312.

In the case of using the enthalpy, the controller 304 in FIG. 8 may derive the enthalpy from the temperature and the humidity in accordance with a predetermined relationship among the temperature, the humidity, and the enthalpy, as in the case of the controller 204 in FIG. 7.

Each of the intake sensor 351 and the outlet sensor 361 may be an enthalpy sensor for detecting the enthalpy. The controller 304 may periodically detect the enthalpies by periodically receiving the enthalpies from the intake sensor 351 and the outlet sensor 361, respectively.

The elements illustrated in FIG. 8 may be optionally and selectively added to the showcase 100 illustrated in FIG. 4. For example, the showcase 300 may not include elements such as the cooler 305 and the cold air circulation duct 331 not corresponding to the elements of the showcase 100 among the elements illustrated in FIG. 8. These elements may be provided in the store equipped with the showcase 300 or any other place.

When only the intake sensor 351, out of the intake sensor 351 and the outlet sensor 361, is used for detecting the temperature or the enthalpy, the showcase 300 may not include the outlet sensor 361. When the second timing is defined as the timing having a high frequency of taking out products, or as the timing having a large number of customers in the store, the showcase 300 may not include both the intake sensor 351 and the outlet sensor 361.

The showcases 100, 200, and 300 may be installed in any facility such as a factory or an office without any limitation instead of the store.

As described above, the showcase and the like of the present disclosure can reduce the increase of the cooling load due to disturbance.

In the above embodiment, the elements may be formed of dedicated hardware or be implemented by execution of a software program adapted to the elements. The elements may be implemented by a program executor, such as a CPU or a processor, which reads a software program stored in a record medium, such as a hard disk or a semiconductor memory, and executes the software program. Here, the software for implementing the showcase and the like of the above embodiment is a program as below.

Specifically, the program allows a computer to execute a method of operating a showcase that includes steps of: sending air for a first air curtain by a first airflow generator; sending air for a second air curtain to flow outside the first air curtain, by a second airflow generator; and keeping the first airflow generator operating and stopping the second airflow generator upon arrival of a second timing when a break of the second air curtain due to disturbance is greater than that at a first timing.

In the above embodiment, the elements may be formed of circuits. Two or more elements may be formed of a single circuit as a whole, or of respective circuits. The circuit may be a versatile or dedicated circuit.

Although the showcase and the like according to one or more aspects are described above based on the embodiment, the present disclosure is not limited to the embodiment. Various modifications of the embodiment conceivable by those skilled in the art, and forms constructed by combining the elements of different embodiments may also be included in the one or more aspects of the present disclosure without departing from the spirit of the present disclosure.

For example, in the above embodiment, the processing executed by a specific element may be executed by another element instead of the specific element. The order of the steps of the processing may be changed, and the steps of the processing may be executed in parallel.

The present disclosure can be used for a showcase, and can be applied to an open showcase installed in a store or the like, for example.

What is claimed is:

1. A showcase comprising:

a casing having a front opening through which a product is picked up;

a product storage located in the casing and including a shelf on which the product is displayed;

a first airflow generator that sends air for a first air curtain to flow outside along the product storage;

a second airflow generator that sends air for a second air curtain to flow outside along the first air curtain;

a first intake that sucks air for the first air curtain; and a controller configured to control the first and second airflow generators, wherein:

the showcase operates in a first period and a second period in which a degree of disturbance of the second air curtain in the second period is greater than in the first period, the controller determines the degree of disturbance based on at least one of (i) a temperature of air flowing into the first intake that sucks air for the first air curtain, and (ii) an enthalpy of air flowing into the first intake, and determines the second period based on the degree of disturbance, the controller, in the second period, causes the first airflow generator to operate and causes the second airflow generator to reduce an output of the second airflow generator than in the first period, and in the second period, the controller causes the first airflow generator to reduce an output of the first airflow generator and the output of the second airflow generator to be reduced from their respective outputs during the first period.

2. The showcase according to claim 1, wherein in the second period, the controller causes the second airflow generator to reduce the output of the second airflow generator such that the output of the second airflow generator becomes lower than an output of the first airflow generator.

3. The showcase according to claim 2, wherein in the second period, the controller stops the output of the second airflow generator.

4. The showcase according to claim 1, wherein a temperature of air for the second air curtain is higher than a temperature of air for the first air curtain.

5. The showcase according to claim 1, wherein the temperature of air flowing into the first intake in the second period is higher than the temperature of air flowing into the first intake in the first period.

6. The showcase according to claim 1, wherein the enthalpy of air flowing into the first intake in the second period is higher than the enthalpy of air flowing into the first intake in the first period.

7. The showcase according to claim 1, wherein the number of customers in the store equipped with the showcase in the second period is larger than the number of customers the first period.

8. The showcase according to claim 1, further comprising:

a second intake that sucks air for the second air curtain; and a cooler to cool the air sucked from the first intake and the second intake.

9. An operation method of a showcase operable in a first period and a second period, comprising:

sending air for a first air curtain by a first airflow generator;

sending air for a second air curtain to flow outside along the first air curtain, by a second airflow generator;

determining a degree of disturbance based on at least one of (i) a temperature of air flowing into a first intake that sucks air for the first air curtain, and (ii) an enthalpy of air flowing into the first intake;

determining the second period based on the degree of disturbance; and causing, in the second period, the first airflow generator to operate and the second airflow generator to reduce an output of the second airflow generator than in the first period, and causing, in the second period, the first airflow generator to reduce an output of the first airflow generator and the output of the second airflow generator to be reduced from their respective outputs during the first period, wherein the degree of disturbance of the second air curtain in the second period is greater than the degree of disturbance of the second air curtain in the first period.

* * * * *